United States Patent [19]

Sakich

[11] Patent Number: 5,043,838

[45] Date of Patent: Aug. 27, 1991

[54] MODULAR ELECTRICAL ASSEMBLIES WITH PRESSURE RELIEF

[75] Inventor: John D. Sakich, Wadsworth, Ohio

[73] Assignee: Hubbell Incorporated, Orange, Conn.

[21] Appl. No.: 409,731

[22] Filed: Sep. 20, 1989

Related U.S. Application Data

[63] Continuation of Ser. No. 176,317, Mar. 31, 1989, abandoned.

[51] Int. Cl.[5] ..... H02H 9/04

[52] U.S. Cl. ..... 361/117; 361/127; 361/119; 378/113; 378/21; 174/178

[58] Field of Search ..... 361/117, 119, 126-128, 361/120, 331; 174/178; 338/21, 113

[56] References Cited

U.S. PATENT DOCUMENTS

| | | | |
|---|---|---|---|
| 3,283,196 | 11/1966 | Parker . | |
| 4,282,557 | 8/1981 | Stetson | 361/117 |
| 4,463,405 | 7/1984 | Koch | 361/135 |
| 4,656,555 | 4/1987 | Baudabaugh | 361/117 |
| 4,812,944 | 3/1989 | Eberhard | 361/117 |

OTHER PUBLICATIONS

*Ohio Brass,* Catalog 94, DynaVar PDV-65 and PDV-100 Distribution Class Surge Arresters, Copyright 1988.

*Primary Examiner*—DeBoer Todd E.
*Attorney, Agent, or Firm*—Jerry M. Presson; Mark S. Bicks

[57] ABSTRACT

A modular electrical assembly is enclosed in an elastomeric weathershed housing, and has a plurality of electrical components aligned in a row and in electrical connection with one another via their axially-directed ends and under an axially-directed compressive force via a non-conductive filament winding. The filament winding defines a crisscross pattern with lateral openings for venting gas upon failure of one of the electrical components. The openings can be filled with fracturable epoxy or other insulating materials such as silicone grease.

40 Claims, 2 Drawing Sheets

MODULAR ELECTRICAL ASSEMBLIES WITH PRESSURE RELIEF

This is a continuation of application Ser. No. 176,317, filed Mar. 31, 1989, now abandoned.

FIELD OF THE INVENTION

The present invention relates to polymer housed electrical assemblies which are formed as modules and which can be selectively coupled together to vary the overall electrical rating of the device. Each electrical assembly is formed from electrical components that are wrapped with a non-conductive filament winding in a pattern with lateral openings for relieving gas pressure. The components can be varistors, resistors, capacitors, or any combination thereof.

BACKGROUND OF THE INVENTION

A surge protector or arrester is commonly connected across a comparatively expensive piece of electrical equipment to shunt over-current surges. Such over-current surges occur, for example, when lightning strikes. When this happens, the surge arrester shunts the surge to ground, thereby protecting the piece of electrical equipment and the circuit from damage or destruction.

Present day surge arresters commonly include an elongated, hollow cylindrical housing made of porcelain or the like, and a plurality of non-linear resistive blocks within the housing. Some of these structures also include spark gaps, the blocks and gaps being electrically interconnected to handle voltage and current surge conditions arising on a power line. The blocks commonly contain silicone carbide (SIC) or metal oxide varistors (MOV), and are usually in the shape of relatively short cylinders stacked within the arrester housing. The number of blocks employed is a function of the material (SIC or MOV) and the voltage and current ratings of the assembly.

For a surge arrester to function properly, intimate contact must be maintained between the MOV or SIC blocks. This necessitates placing an axial load on the blocks within the housing. Prior art arresters utilize bulky contact springs within the housing to provide this axial load. Typically, these springs can provide only relatively small loads, for example, about sixty pounds. As a result, prior art surge arresters experience one or more problems such as poor heat transfer between the MOV or SIC blocks and arrester terminals; non-uniform current distribution; and high contact resistances at joints. Furthermore, units having low contact force sputter and the ionized metal which is produced can cause axial flashover at high currents.

An additional problem with surge arresters of the prior art is that they, on rare occasions, fail in a dangerous fashion. When these arresters fail and experience high fault currents producing high internal gas pressures, the bursting unit may throw parts and cause property damage.

In addition, some of the prior art devices are difficult to assemble, have poor dielectric design, are susceptible to water invasion, and require totally different devices to provide varied voltage ratings.

Examples of prior art surge arresters are disclosed in the following U.S. Pat. Nos.: 2,587,587 to Bellezza et al; 2,947,903 to Westrom; 2,997,529 to Fink; 3,018,406 to Innis; 3,261,910 to Jacquier; 3,412,273 to Kennon et al; 3,524,107 to Reitz; 3,566,183 to Olsen; 3,567,541 to Kaczerginski; 3,586,934 to Nakata; 3,706,009 to Reitz; 3,725,745 to Zisa; 3,850,722 to Kreft; 3,973,172 to Yost; 3,987,343 to Cunningham et al; 4,029,380 to Yonkers; 4,092,694 to Stetson; 4,100,588 to Kresge; 4,107,567 to Cunningham et al; 4,161,012 to Cunningham; 4,218,721 to Stetson; 4,404,614 to Koch et al; 4,467,387 to Bergh et al; 4,491,687 to Kaczerginski et al; and U.S. Defensive Publication T102,103, as well as U.K. patents 730,710; 1,109,151; and 1,505,875.

In the surge arresters of commonly assigned U.S. Pat. No. 4,656,555 to Raudabaugh, copending U.S. patent application Ser. No. 033,765, now abandoned, of Donald E. Raudabaugh entitled Polymer Housed Electrical Assemblies Using Modular Construction and filed Apr. 3, 1987, and concurrently filed U.S. patent application Ser. No. 176,319 entitled Modular Electrical Assemblies with Plastic Film Barriers of Donald E. Raudabaugh, the subject matters of which are hereby incorporated by reference, resin soaked glass fibers completely surround and axially compress the varistor blocks. This complete enclosure of the varistor blocks may not permit the gases generated upon varistor block failure to escape to the weathershed housing interior and then out of the weathershed housing before the gas pressure becomes too great and causes the assembly to break apart. If the filament wrap is relatively thin, the wrap can be burned through or can split before an extremely high pressure develops.

SUMMARY OF THE INVENTION

Accordingly, an object of this invention is to provide electrical assemblies, particularly for surge arresters, which can vent gases generated upon electrical component failure to minimize damage, are relatively simple and inexpensive to manufacture, have good dielectric design, resist water invasion, and have modular components and housings to simply vary voltage ratings.

A further object of this invention is to provide electrical assemblies, such as surge arresters, having high axial loadings, thereby resulting in uniform current distribution, low contact resistances at joints, and excellent heat transfer to the arrester terminals.

Another object of this invention is to provide an electrical assembly, such as a surge arrester, having a shatter-proof housing which has a high-impact strength and which does not fail in a dangerous fashion.

Still another object of this invention is to provide a MOV block assembly with greatly improved tensile and cantilever strengths.

Yet another object of this invention is to provide a surge arrester which is forgiving of dimensional variations in associated parts, thereby reducing the need for expensive close tolerances.

The foregoing objects are basically attained by providing a modular electrical assembly including a plurality of conductive electrical components aligned in a row or column and electrically connected through their axially directed ends, and a non-conductive fiber filament winding wrapped about the electrical components. The winding applies an axially directed compressive force on the electrical components to maintain their electrical connection, and defines a pattern with lateral openings therein for venting gases generated upon failure of one of the electrical components.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring to the drawings which form a part of this original disclosure.

DETAILED DESCRIPTION OF PREFERRED EMBODIMENT

Figure 1:
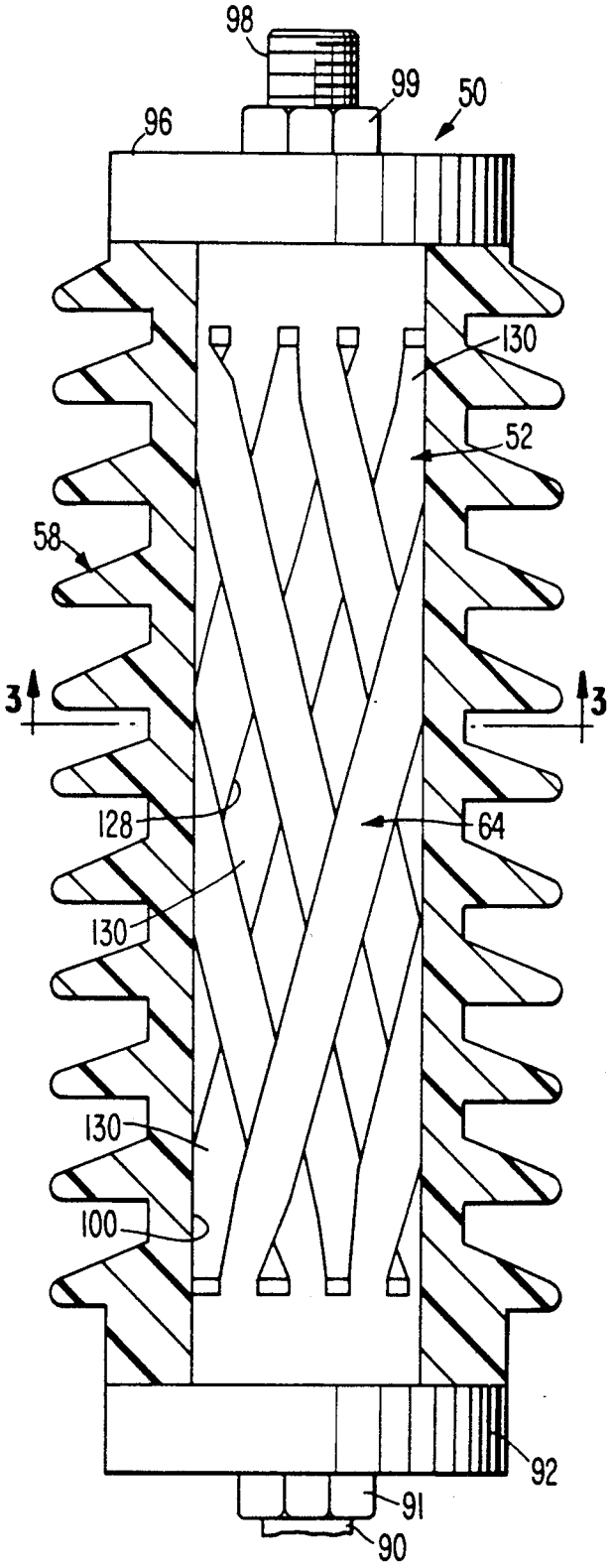
FIG. 1 is a side elevational view in partial section of a modular electrical assembly in the form of a surge arrester, accordance with the present invention, illustrating the outer surface of the filament winding.
Figure 2:
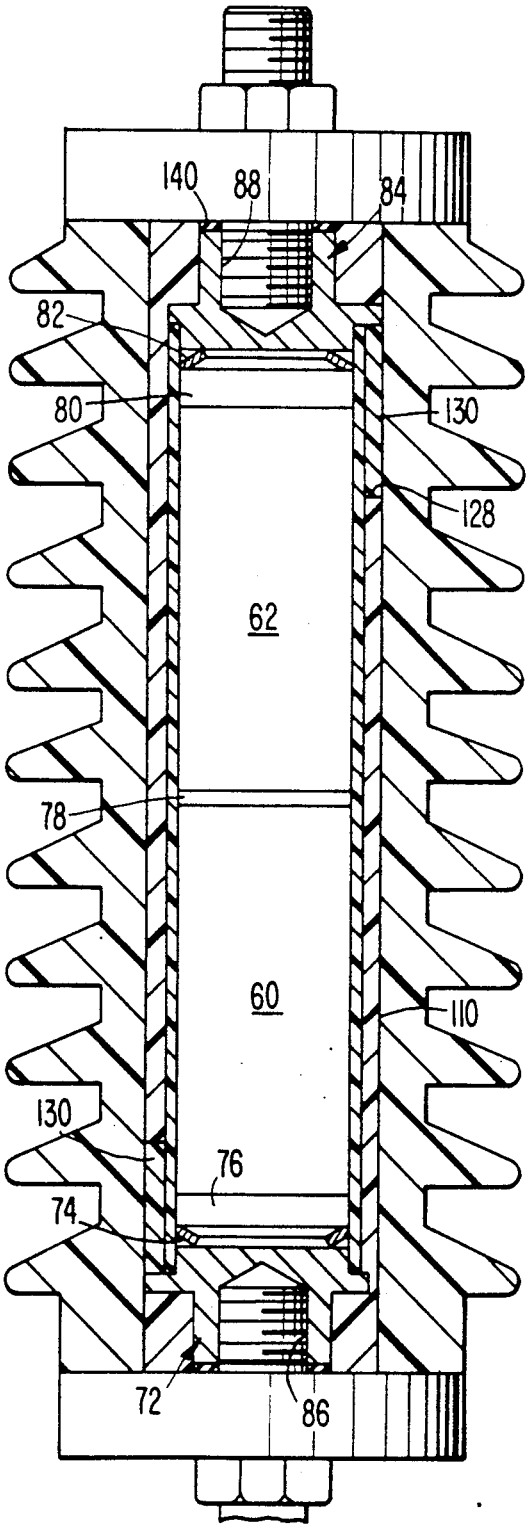
FIG. 2 is a side elevational view in longitudinal section of the assembly illustrated in FIG. 1.
Figure 3:
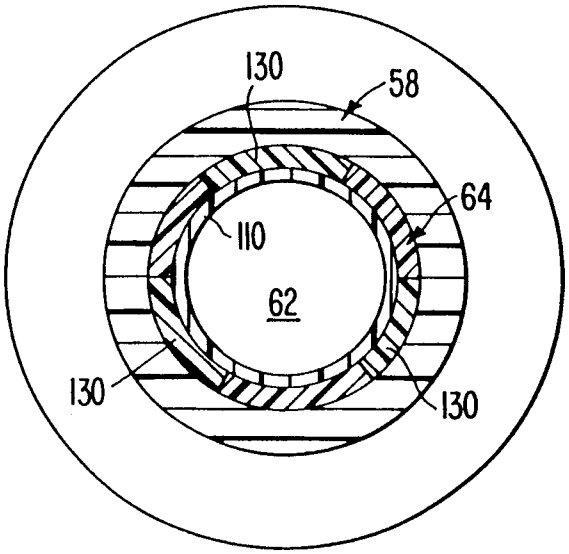
FIG. 3 is an enlarged end elevational view in section taken along 3—3 of FIG. 1.

Referring to FIGS. 1–3, an electrical device 50, in the form of a surge arrester, according to the present invention is formed of a modular electrical assembly 52, enclosed in a polymeric, elastomeric weathershed housing 58. The illustrated electrical assembly can be advantageously substantially identical to and interchangeable with the other electrical assemblies, and is in turn formed from one or a plurality of cylindrical electrical components 60 and 62. These components are aligned in a row, and are in electrical connection with one another through their axially-directed ends and under an axially-directed compressive force developed by a non-conductive filament winding 64, as disclosed in U.S. Pat. No. 4,656,555 and Ser. No. 033,765. The electrical components can be metal oxide varistors (e.g., zinc oxide varistor blocks), resistors, capacitors, or any combination thereof.

In the case of varistors used to form a surge arrester, voltage ratings can be enlarged merely by serially and selectively coupling the plurality of modular electrical assemblies together mechanically and electrically.

The elastomeric weathershed housing 58 receives the electrical assemblies therein via a slight interference fit. This facilitates construction and allows the practice of good dielectric design by reducing radial gaps.

Electrical assembly 52 has a substantially cylindrical overall outer surface and comprises first end member, or terminal 72, spring washer 74, contact disc 76, electrical component 60, contact disc 78, electrical component 62, contact disc 80, spring washer 82, and second end member or terminal 84. Additional spring washers can be employed in the electrical assembly against the contact discs at some or all of the intermediate varistor joints, particularly for base mounted assemblies, to maintain contact pressure when the assembly bends under cantilever loading. The non-conductive filament winding 64 is coupled to end members 72 and 84, encloses the electrical components, and maintains them under an axially-directed force, which is augmented by the spring washers.

A plastic film barrier 110 laterally surrounding electrical components 60 and 62 is interposed coaxially between the electrical components and filament winding 64. Preferably, the plastic is polypropylene. The barrier is formed by wrapping a rectangular plastic sheet tightly about the electrical components and the adjacent portions of end members 72 and 84 in two layers 111 and 112 before filament winding 64 is added. The thickness of the plastic sheet and of each layer is about 0.0005 inch.

Since the plastic film barrier extends along the entire length of the electrical components and onto the end members, the plastic film barrier seals the electrical components from the epoxy or resin on the filament forming the winding. For surge arresters, this prevents the wet epoxy or resin on the filament from bonding to the fragile ceramic insulating collars on the metal oxide varistor blocks 60 and 62. Such bonding can be prevented by other adhesion blockers, such as silicone oil or grease.

Advantageously, end members 72 and 84 are formed from aluminum. They can also be formed of any other material with suitable conductivity and mechanical strength.

End members 72 and 84 form internal terminals, have cylindrical exposed outer surfaces, and have opposite, first and second axially-directed planar ends with internally threaded sockets or bores 86 and 88 formed respectively therein. Socket 86 threadedly receives threaded end stud 90 which can be connected to an electrical power source and is in the form of a metallic, conductive bolt with an internally threaded nut 91. End plate 92 is received on end stud 90, tightly engages an end of the weathershed housing as seen in FIGS. 1 and 2 and is held in place via rigid nut 91 on the stud. For base mounting, a base plate with a bolt circle can be attached. A second end plate 96 is similarly positioned at the other end of the housing and is received on end stud 98 which is connected to ground and maintained thereon via internally threaded nut 99 on the stud. Studs 90 and 98 in essence form external terminals for the overall device 50.

Weathershed housing 58 has a through passageway in the form of a throughbore with an inwardly facing cylindrical surface 100 which tightly receives therein the outer cylindrical surface of the electrical assembly 52. The reception of the assembly in the throughbore is preferably via an interference fit with the assembly having an outer surface diameter that is about 2% to about 9% greater than the throughbore diameter and is substantially constant along its length. This reduces radial gaps and thus provides advantageous dielectric design.

Figure 6:
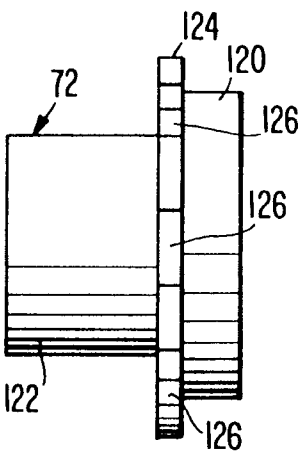
FIG. 6 is a side elevational view of the end member of FIG. 4.
Figure 5:
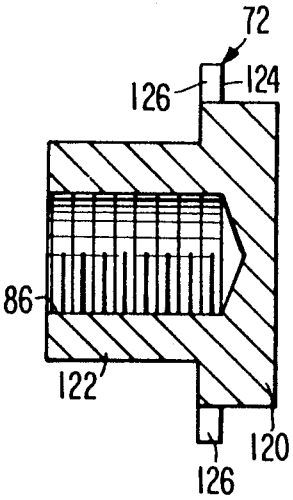
FIG. 5 is a side elevational view in section of the end member taken along line 5—5 of FIG. 4.
Figure 4:
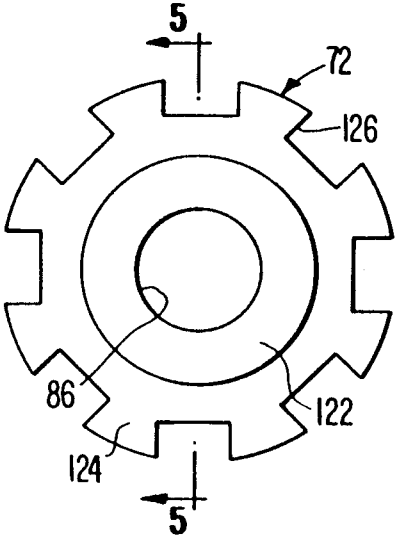
FIG. 4 is an end elevational view of the end member of FIGS. 1 and 2.

Since end members 72 and 84 are identical, only end member 72 is described in detail. Referring particularly to FIGS. 4–6 end member 72 comprises an inner section 120 and an outer section 122 separated by a radially extending flange 124. Inner section 120 is oriented adjacent the electrical components 60 and 62 and has a cylindrical lateral surface with a transverse diameter substantially equal to the electrical components. Inner section 120 defines that portion of the end member which receives film barrier 110. Outer section 122 also has a cylindrical lateral surface, but has a transverse diameter substantially less than inner section 120.

Flange 124 is generally circular in plan view and extends radially outwardly from the interface between sections 120 and 122. Radially inwardly extending and radially outwardly opening notches 126 are formed in the flange. Eight uniformally dimensioned notches are evenly and circumferentially spaced about flange 124 in the illustrated embodiment. The number of notches will vary depending upon the component diameter. More notches will be used with larger component diameters, and less notches will be used with smaller component diameters.

The end members facilitate wrapping a non-conductive filament, e.g., glass in a pattern with diamond shaped lateral openings 128 which are preformed, discrete and longitudinally segmented as illustrated in FIG. 1. Openings 128 are filled with a fracturable insulating material 130 having suitable insulating and mechanical characteristics, for example epoxy. Other suitable insulating materials include polyester, foam, rubber, silicone grease or gas, such as air. If the housing is molded about the electrical assembly wrap, the molded housing material can fill the openings.

The non-conductive filament is wrapped longitudinally (i.e., extending in directions substantially parallel to the arrester longitudinal axis) and crosswise around the varistor blocks (i.e., extending in directions substantially transverse to the arrester longitudinal axis).

Figure 9:
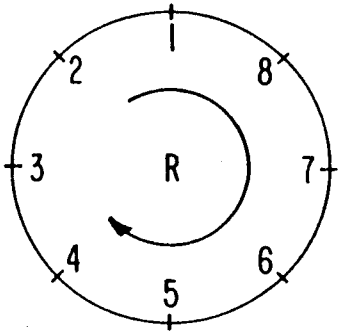
FIG. 7–9 are diagrammatic illustrations of the wrap plan for forming pattern of the filament winding of FIG. 1.
Figure 8:
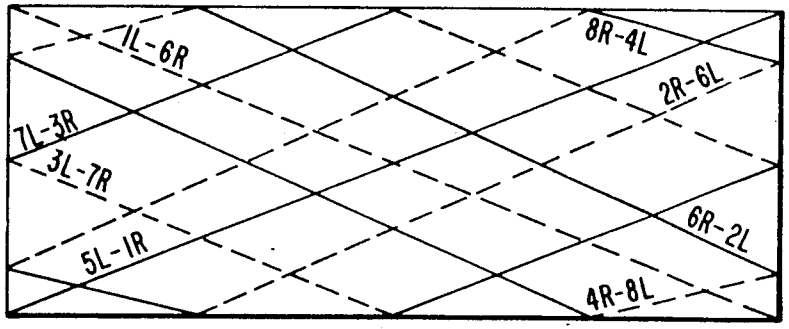
Figure 7:
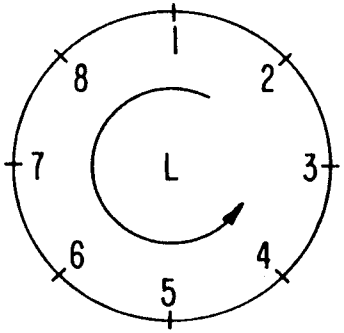

The crisscross winding pattern illustrated in FIG. 1 is formed by wrapping one filament, or preferably a plurality of filaments simultaneously (typically 9) according to the pattern diagrammatically illustrated in FIGS. 7–9 wherein the end member notches 126 are spaced at 45° angles. The wrap plan used for a particular arrester will depend on component diameter, length and mechanical requirements. In these figures, end members 72 and 84 are denoted by the letters "L" and "R" in FIGS. 7 and 9, respectively. The individual notches 126 in each end member are numbered 1 through 8, respectively. In passing from end member to the other, the assembly is rotated through 180° as a filament is moved axially. Subsequently, the filament is rotated at the end member through an angle of 315° to the next notch position. This specific pattern illustrated is as follows and is illustrated in FIG. 8:

| From | To | Rotation |
|---|---|---|
| 1 L | 5 R | 180° |
| 5 R | 4 R | 315° |
| 4 R | 8 L | 180° |
| 8 L | 7 L | 315° |
| 7 L | 3 R | 180° |
| 3 R | 2 R | 315° |
| 2 R | 6 L | 180° |
| 6 L | 5 L | 315° |
| 5 L | 1 R | 180° |
| 1 R | 8 R | 315° |
| 8 R | 4 L | 180° |
| 4 L | 3 L | 315° |
| 3 L | 7 R | 180° |
| 7 R | 6 R | 315° |
| 6 R | 2 L | 180° |
| 2 L | 1 L | 315° |

The pattern is repeated until the filament develops a thickness equal to the lateral peripheral extent of flange 124. Additional fiber filament is wound about the outer sections 122 until the filament surrounding such sections has an outer peripheral surface at least equal to the outermost extension of the flange. The outer surface of the assembly is then abraded to the extent necessary to provide a uniform cylindrical surface along its entire length.

The insulating material 130 fills the openings 128 to maintain the desired uniform cylindrical surface of assembly 52. However, insulating material 130 can readily break or separate upon the development of adequate internal pressure within the winding, which pressure exceeds the threshold level permitted by epoxy or other insulating material against rupture, to permit gas to vent. Thus, openings 128 form venting means in the tubular member formed by filament winding 64 to facilitate the lateral egress through the filament winding of gaseous products produced by the stack of electrical components 60 and 62.

Upon electrical component failure, gas is released developing tremendous gas pressure within the fiber filament winding. This pressure causes the epoxy or other insulating material to fracture and the gas to escape to the inside of weathershed housing 58. Due to the flexible and resilient nature of elastomeric weathershed housing 58, the housing will expand, permitting the gas to flow along the length of the housing inner surface and out its axial ends. The gas can also vent between adjacent housings in a stacked arrangement, or through a split in the elastomeric housing. Once the gas is released, the housing will contract and again tightly bear against assembly 52. Without this venting of the gas, the gas would be entrapped within the winding until the increasing gas pressure causes an explosion of the assembly. After venting, ionized gas causes an external arc bridging the damaged arrester to relieve the internal fault.

To mechanically and electrically connect a plurality of the electrical assemblies together in an aligned, straight end-to-end serial array, externally threaded, metallic, and conductive studs can be used. These studs are advantageously substantially identical and interchangeable, as well as substantially rigid and formed of stainless steel. The studs couple the adjacent ends of adjacent assemblies by being threadedly received in the threaded sockets in each assembly's adjacent end member. The adjacent ends of adjacent assemblies are screwed tightly together on the studs to provide a substantially gap-free engagement between the facing planar, axially-directed outer ends of the end members thereon. This provides an advantageous electrical and mechanical interface by reducing possible separation during bending of the device. Plural weathershed housing sections, or a larger, one-piece housing can be used.

To provide sealing against water invasion, preferably a gasket 140 is interposed between each end member and the adjacent end plate, and silicone grease is interposed between each adjacent end plate and end member, between adjacent end members, and between the outer surfaces of the electrical assemblies and the inwardly facing surfaces of the throughbore in each weathershed housing section. Use of grease between the weathershed housing section and the electrical assembly aids in construction and assembly by reducing friction and also reduces any radial gaps therebetween.

Advantageously, the longitudinal axes of the studs, the electrical components in each assembly, and the weathershed housing 58 are coaxially aligned. Preferably, the planar ends of the end members are perpendicular to these aligned longitudinal axes.

Preferably, with regard to the electrical device 50, the axial load on the electrical components before winding is about 750 pounds per square inch, and the filament or stranded element of fibers is wet, epoxy coated fiberglass which is wound through about 100 turns and is cured for about two hours at 150° C.

While a particular embodiment has been chosen to illustrate the invention, it will be understood by those skilled in the art that various changes and modifications can be made therein without departing from the scope of the invention as defined in the appended claims.

What is claimed is:

1. An electrical surge arrester assembly, comprising:

a plurality of cylindrical surge arrester components arranged substantially coaxially to form a cylindrical stack of components having a longitudinal axis, said components having nonlinear voltage-current characteristics;

first and second electrically conductive terminals mounted at opposite respective ends of said stack and electrically coupled to said components, said terminals having radial surface portions substantially concentric with respect to said longitudinal axis;

a nonconductive tubular member encompassing said stack longitudinally and crosswise and having first and second opposite ends with radially projecting parts engaging and connected respectively to said radial surface portions of said terminals, said tubular member having sufficient structural strength to apply an axially-directed compressive force by way of said terminals to said arrester components sufficient to maintain electrical contact between said components of said stack and said terminals, said tubular member being a winding having a first plurality of strand portions forming a first layer and a first opening therein and having a second plurality of strand portions forming a second layer and a second opening therein, said first and second openings having substantially the same shape and being substantially aligned to form a common opening providing preformed venting means to facilitate lateral egress therethrough of gaseous products produced by said stack; and a housing encompassing said tubular member and cooperating therewith to at least partially control the expulsion of the gaseous products from the assembly.

2. The assembly according to claim 1, wherein said housing is resilient.

3. The assembly according to claim 2, wherein said tubular member is rigid against bending in directions transverse to said longitudinal axis, and further wherein said housing is supported against bending by said tubular member.

4. The assembly according to claim 3, wherein said tubular member is composed of filamentary material.

5. The assembly according to claim 4, wherein said filamentary material is comprised of a continuous strand wound a plurality of times to form a generally crisscross pattern in said member.

6. The assembly according to claim 5, wherein the opening is substantially diamond-shaped.

7. The assembly according to claim 4, wherein the opening is filled with a fracturable insulating material.

8. The assembly according to claim 2, wherein said housing encompasses at least part of said terminals and encompasses said stack with an interference fit.

9. A modular electrical assembly, comprising:

a plurality of conductive electrical components, aligned in a column along an axis and having axially directed ends, said electrical components being electrically connected at said axially directed ends;

first and second conductive end members located at opposite ends of said column, said end members having shoulder extending radially relative to said axis; and a non-conductive winding wrapped in a predetermined pattern longitudinally and crosswise about said electrical components and said end members, engaging said shoulders, and applying an axially directed compressive force through said shoulders on said electrical components and end members to maintain electrical connection therebetween, said winding having a first plurality of strand portions forming a first layer and a first opening therein and having a second plurality of strand portions forming a second layer and a second opening therein, said first and second openings having substantially the same shape and being substantially aligned to form a common opening for venting gas upon failure of one of said electrical components, said common opening extending completely through said winding radially relative to said axis.

10. A modular electrical assembly according to claim 9 wherein said openings are filled with fracturable insulating material.

11. A modular electrical assembly according to claim 10 wherein said fracturable insulating material is epoxy.

12. A modular electrical assembly according to claim 9 wherein an elastomeric housing coaxially surrounds and frictionally engages said winding.

13. A modular electrical assembly according to claim 12 wherein said housing has an internal throughbore forming an interference fit with said winding.

14. A modular electrical assembly according to claim 9 wherein a barrier laterally surrounds said electrical components and is interposed between said electrical components and said winding.

15. A modular electrical assembly according to claim 9 wherein said electrical components are varistors.

16. A modular electrical assembly according to claim 15 wherein said varistors are generally cylindrical metal oxide varistors.

17. A modular electrical assembly according to claim 9 wherein said electrical components are generally cylindrical varistor blocks; and said end members comprise cylindrical inner sections having substantially equal transverse diameters with said varistor blocks.

18. A modular electrical assembly according to claim 9 wherein each said shoulder comprises a radially extending flange on the respective end member with circumferentially spaced notches therein, said notches receiving portions of said winding to define said pattern, opening radially outwardly relative to said axis and extending through said flanges axially relative to said axis.

19. A modular electrical assembly according to claim 18 wherein each said end member comprises a reduced diameter section on a side of the flange thereof remote from said electrical components, said winding extending about said reduced diameter section to provide a substantially uniform transverse diameter along the entire axial length of the electrical assembly.

20. A modular electrical assembly according to claim 19 wherein each said reduced diameter section comprises an internally threaded bore.

21. A modular electrical assembly according to claim 9 wherein said openings are filled with insulating material.

22. A modular electrical assembly according to claim 21 wherein said insulating material is grease.

23. A modular electrical assembly according to claim 9 wherein said pattern is a crisscross pattern and said openings are generally diamond shaped.

24. A modular electrical assembly according to claim 9 wherein said winding is wrapped about said electrical components and said end members while said electrical components and said end members are axially compressed.

25. A modular electrical assembly according to claim 9 wherein said winding comprises a plurality of common openings which are discrete and longitudinally segmented.

26. A surge arrester, comprising:

a plurality of generally cylindrical, metal oxide varistor blocks aligned in a column along an axis and having axially directed ends, said varistor blocks being in electrical connection with one another through said axially directed ends;

first and second generally cylindrical, conductive terminals at opposite ends of said column, each said terminal having a first axial end in contact with one of said varistor blocks, an opposite second axial end with an internally threaded socket and a shoulder extending radially relative to said axis between said ends, said varistor blocks and said terminals having substantially equal transverse diameters;

compression means, wrapped longitudinally and crosswise around said varistor blocks and said terminals in a predetermined crisscross pattern, for applying an axially-directed compressive force through said shoulder on said varistor blocks and said terminals to maintain electrical connection thereof, said compression means including a non-conductive winding having a first plurality of strand portions forming a first layer and first openings therein and a second plurality of strand portions forming a second layer and second openings therein, respective first and second openings having substantially the same shape and being substantially aligned to form common preformed lateral openings in said winding for venting gas upon failure of one of said varistor blocks, said lateral openings extending completely through said winding radially relative to said axis; and elastomeric weathershed means, resiliently enclosing said varistor blocks, for protecting said varistor blocks, said weathershed means having a substantially cylindrical throughbore with a diameter substantially equal to a transverse diameter of said compression means.

27. A surge arrester according to claim 26 wherein said openings are filled with insulating material.

28. A surge arrester according to claim 27 wherein said insulating material is fracturable epoxy.

29. A surge arrester according to claim 27 wherein said insulating material is grease.

30. A surge arrester according to claim 27 wherein said insulating material is fracturable.

31. A surge arrester according to claim 26 wherein said winding is wrapped about said varistor blocks and said terminals while said varistor blocks and said terminals are axially compressed.

32. A surge arrester according to claim 26 wherein said lateral openings are generally diamond shaped.

33. A surge arrester according to claim 26 wherein each said shoulder comprises a radially extending flange on the respective terminal with circumferentially spaced notches therein, said notches receiving portions of said winding to define said pattern, opening radially outwardly relative to said axis and extending through said flanges axially relative to said axis.

34. A modular electrical assembly, comprising:

a plurality of conductive electrical components, aligned in a column along an axis and having axially directed ends, said electrical components being electrically connected at said axially directed ends;

first and second conductive end members located at opposite ends of said column, said end members having shoulders extending radially relative to said axis;

a non-conductive filament winding wrapped in a predetermined pattern about said electrical components and said end members, engaging said shoulders, and applying an axially directed compressive force through said shoulders on said electrical components and end members to maintain electrical connection therebetween, said winding having a first plurality of strand portions forming a first layer and first openings therein and a second plurality of strand portions forming a second layer and second openings therein, respective first and second openings having substantially the same shape and being substantially aligned to form common lateral openings in said winding for venting gas upon failure of one of said electrical components, said lateral openings extending completely through said winding radially relative to said axis; and fracturable insulating material filling said openings.

35. A modular electrical assembly according to claim 34 wherein said fracturable insulating material is epoxy.

36. A modular electrical assembly according to claim 34 wherein an elastomeric housing coaxially surrounds and fractionally engages said filament winding.

37. A modular electrical assembly according to claim 36 wherein said housing has an internal throughbore forming an interference fit with said filament winding.

38. A modular electrical assembly according to claim 34 wherein said electrical components are varistors.

39. A modular electrical assembly according to claim 38 wherein said varistors are generally cylindrical metal oxide varistors.

40. A modular electrical assembly according to claim 34 wherein said pattern is a crisscross pattern and said lateral openings are generally diamond shaped.

* * * * *